US009352238B2

(12) United States Patent
Nuttall et al.

(10) Patent No.: US 9,352,238 B2
(45) Date of Patent: May 31, 2016

(54) TOY VEHICLE TRACK SET

(71) Applicant: Mattel, Inc., El Segundo, CA (US)

(72) Inventors: Michael W. Nuttall, South Pasadena, CA (US); Sang Joon Kwak, La Habra, CA (US)

(73) Assignee: Mattel, Inc., El Segundo, CA (US)

( * ) Notice: Subject to any disclaimer, the term of this patent is extended or adjusted under 35 U.S.C. 154(b) by 80 days.

(21) Appl. No.: 14/039,946

(22) Filed: Sep. 27, 2013

(65) Prior Publication Data

US 2014/0099860 A1 Apr. 10, 2014

Related U.S. Application Data

(60) Provisional application No. 61/710,047, filed on Oct. 5, 2012.

(51) Int. Cl.

| | |
|---|---|
| ***A63H 18/00*** | (2006.01) |
| ***A63H 18/16*** | (2006.01) |
| ***A63H 18/04*** | (2006.01) |
| ***A63H 27/14*** | (2006.01) |

(52) U.S. Cl.

CPC ..... *A63H 18/16* (2013.01); *A63H 18/005* (2013.01); *A63H 18/04* (2013.01); *A63H 27/14* (2013.01)

(58) Field of Classification Search

CPC ..... A63H 18/04; A63H 18/005; A63H 27/14; A63H 18/028; A63H 18/02; A63H 17/008; A63H 18/025

USPC ..... 446/433, 435, 444

See application file for complete search history.

(56) References Cited

U.S. PATENT DOCUMENTS

| | | | | |
|---|---|---|---|---|
| 1,879,986 | A * | 9/1932 | Macklin | A63H 27/14 446/65 |
| 2,327,702 | A | 8/1943 | Flynt | |
| 3,376,844 | A | 4/1968 | Wood | |
| 3,509,662 | A | 5/1970 | Lunzer | |
| 3,603,024 | A * | 9/1971 | Davis | A63H 27/14 446/435 |
| 4,005,543 | A | 2/1977 | McKay | |
| 4,108,437 | A | 8/1978 | DeAnda et al. | |
| 4,475,303 | A | 10/1984 | Ribas et al. | |
| 4,605,229 | A | 8/1986 | McKay | |
| 4,715,602 | A | 12/1987 | May et al. | |
| 4,872,680 | A | 10/1989 | Dennis | |
| 5,052,973 | A * | 10/1991 | Rudell et al. | 446/429 |
| 5,234,216 | A | 8/1993 | Ostendorff | |
| 5,651,736 | A | 7/1997 | Myers | |
| 6,830,498 | B2 | 12/2004 | Elling | |
| 7,018,264 | B2 | 3/2006 | Foster et al. | |
| 7,241,223 | B1 | 7/2007 | Caudill | |
| 7,285,035 | B1 | 10/2007 | Tullis | |
| 7,651,398 | B2 | 1/2010 | Ostendorff et al. | |
| 7,794,301 | B2 | 9/2010 | Ostendorff et al. | |
| 7,857,679 | B2 | 12/2010 | O'Connor et al. | |

(Continued)

*Primary Examiner* — Vishu Mendiratta

(74) *Attorney, Agent, or Firm* — Edell, Sharpiro & Finnan, LLC

(57) ABSTRACT

A track set is provided, the track set having: a toy vehicle; a toy airplane; a launcher for launching the toy airplane; a trigger mechanism coupled to the launcher, wherein the trigger mechanism is located in a portion of a track path of the track set; and wherein actuation of the trigger mechanism by the toy vehicle as it travels along the track path launches the toy airplane from the launcher towards an indicator mechanism configured to be contacted by the toy vehicle traveling along the track path and the toy airplane after it has been launched from the launcher.

20 Claims, 4 Drawing Sheets

(56) References Cited

U.S. PATENT DOCUMENTS

| | | | | |
|---|---|---|---|---|
| 7,874,892 | B2 | 1/2011 | Hippely | |
| 7,901,266 | B2 | 3/2011 | Ostendorff | |
| 2010/0273394 | A1* | 10/2010 | O'Connor et al. | 446/429 |
| 2010/0291833 | A1 | 11/2010 | O'Connor et al. | |

* cited by examiner

TOY VEHICLE TRACK SET

CROSS REFERENCE TO RELATED APPLICATIONS

This application claims the benefit of U.S. Provisional Patent Application Ser. No. 61/710,047, filed Oct. 5, 2012, the contents of which are incorporated herein by reference thereto.

BACKGROUND

Play sets for toy vehicles are popular toys which are known to provide entertainment and excitement to a user. These play sets typically include a track configuration intended to guide a propelled toy vehicle, such as a 1/64 scale die-cast metal toy vehicle, through a course. The track configurations include closed-loop continuous track arrangements and open-end arrangements. Toy vehicles are placed on these play set tracks and propelled across the configuration by hand or by an external propulsion means.

To bring increased entertainment and excitement to play sets, track configurations may include features such as intersecting tracks, loop segments, and other types of track configurations.

Accordingly, a play set for toy vehicles that provides variations in play is desired.

BRIEF SUMMARY OF INVENTION

In one embodiment, a track set is provided, the track set having: a track path; an indicator mechanism; a toy vehicle; a toy airplane; a launcher for launching the toy airplane; and a trigger mechanism coupled to the launcher, wherein the trigger mechanism is located in a portion of the track path of the toy vehicle track set, and actuation of the trigger mechanism by the toy vehicle as the toy vehicle travels along the track path launches the toy airplane from the launcher towards the indicator mechanism configured to be contacted by the toy vehicle traveling along the track path and the toy airplane after the toy airplane has been launched from the launcher.

In another exemplary embodiment, a track set for toy vehicles is provided, the track set having: a plurality of track segments defining a track path; a first toy vehicle configured to travel along the track path; a second toy vehicle; a launcher configured for launching the second toy vehicle, the launcher having a trigger mechanism movably mounted to the launcher for movement between a first position and a second position, wherein movement of the trigger mechanism from the first position to the second position is caused by the first toy vehicle traveling along a portion of the track path that passes through the launcher and movement of the trigger mechanism from the first position to the second position causes the second toy vehicle to be launched from the launcher; and an indicator mechanism configured to be contacted by the first toy vehicle traveling along the track path and the second toy vehicle after the second toy vehicle has been launched from the launcher.

In another embodiment, a method for racing a toy vehicle against a toy airplane is provided. The method including the steps of: moving the toy vehicle along a track path; contacting and moving a trigger mechanism of a launcher as the toy vehicle moves along the track path, wherein the movement of the trigger mechanism releases the toy airplane from the launcher and the toy airplane and the toy vehicle travel simultaneously towards an indicator mechanism, the indicator mechanism being configured to be contacted by the toy vehicle traveling along the track path and the toy airplane after it has been launched from the launcher; and indicating which of the toy vehicle and the toy airplane has reached the indicator mechanism first.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
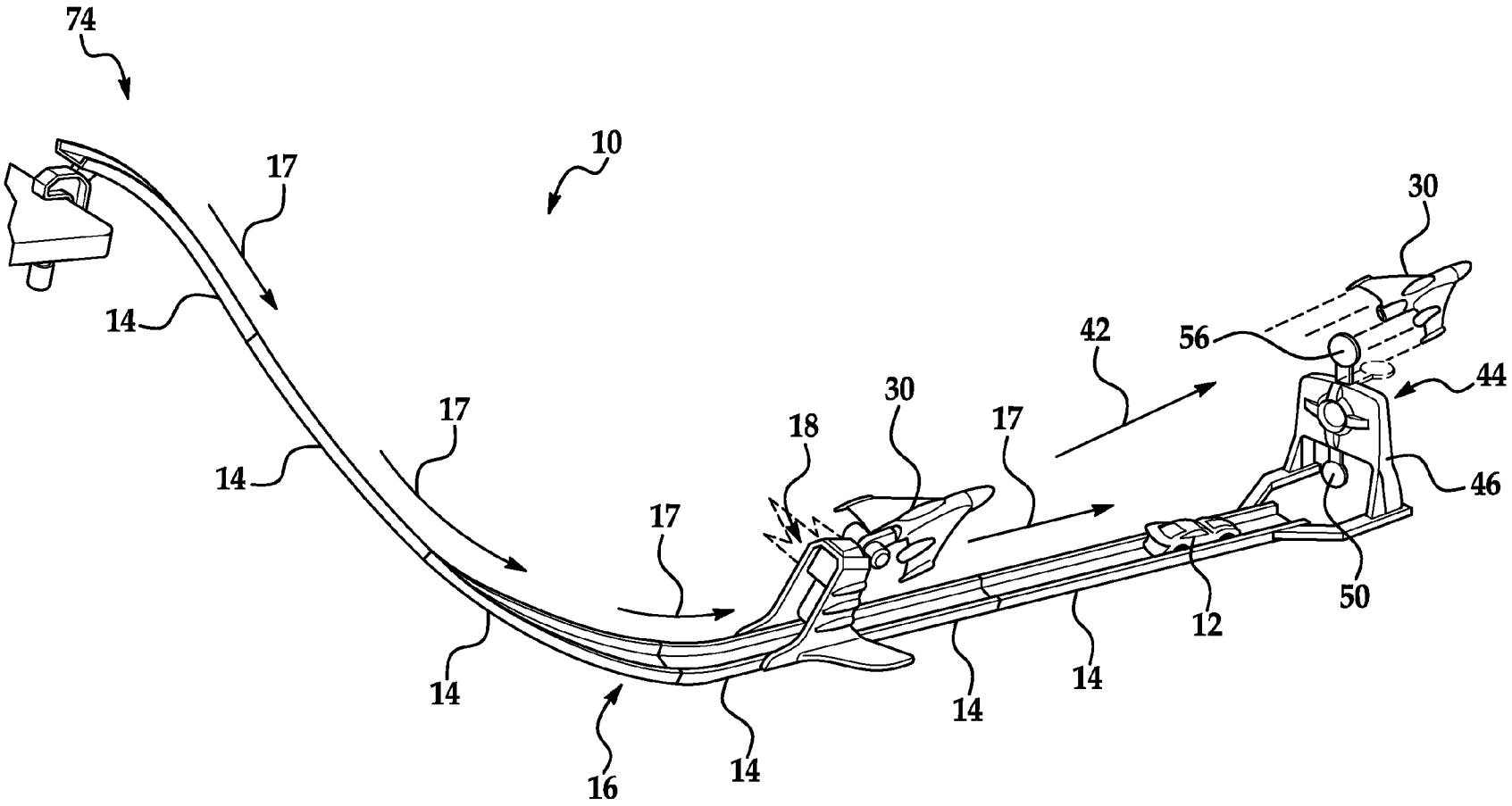
FIG. 1 is a perspective view of a track set according to an exemplary embodiment of the present invention.

FIG. 1 illustrates an exemplary play set or track set 10 for toy vehicles or objects 12 according to one non-limiting embodiment of the present invention. The play set 10 includes a plurality of track segments 14 configured to be secured to each other using connectors in accordance with known technologies in order to define a track path 16. In one embodiment, the objects 12 are toy vehicles configured to travel along the track path 16 in the direction of arrows 17.

Figure 2B:
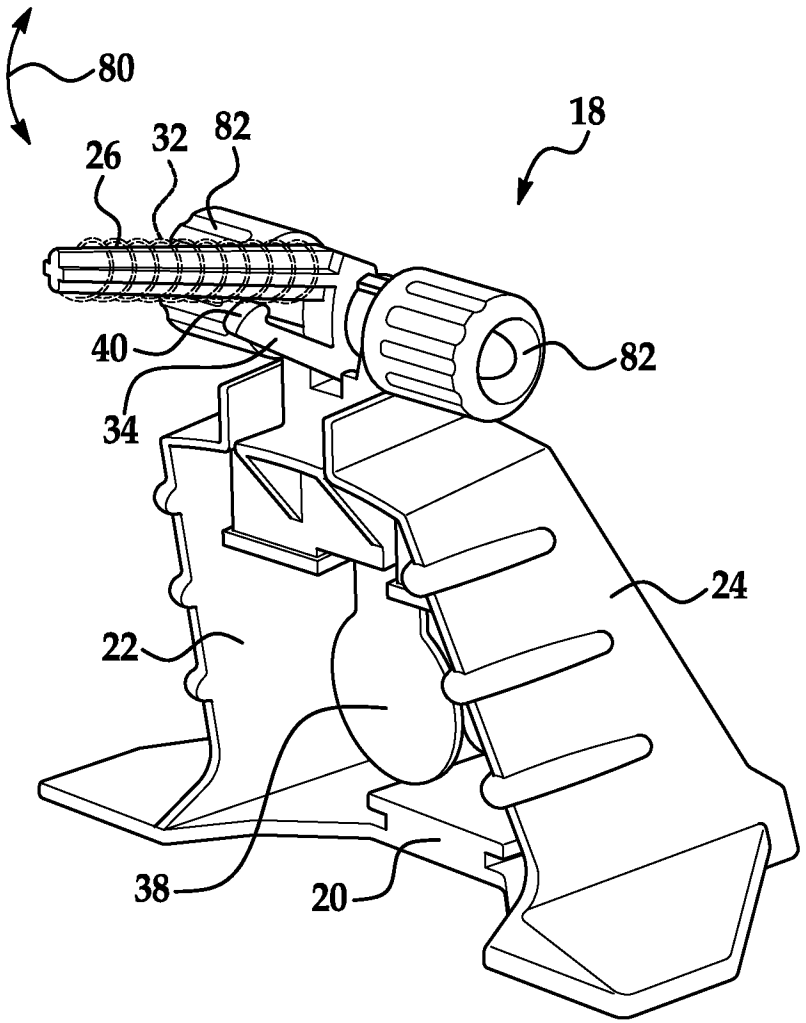
FIG. 2B is a rearward perspective view of the launcher.
Figure 2A:
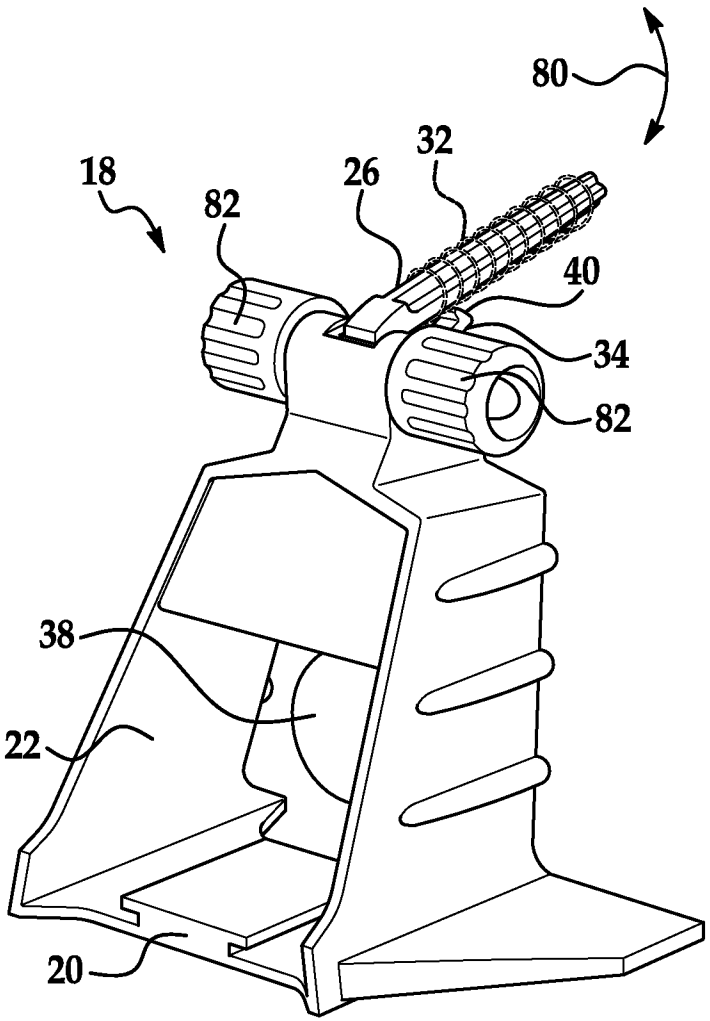
FIG. 2A is a forward perspective view of a launcher for use with the track set.

The play set or track set 10 further comprises a launcher 18 that is configured to be located between a pair of track segments 14 or coupled to a track segment 14 forming the track path 16. Launcher 18 is also illustrated in FIGS. 2A and 2B. Launcher 18 has a connector portion 20 configured to slidably receive a pair of track segments 14 such that a portion of the track path 16 passes through an opening 22 defined by a structure 24 that is located above a portion of the track path 16.

Figure 4B:
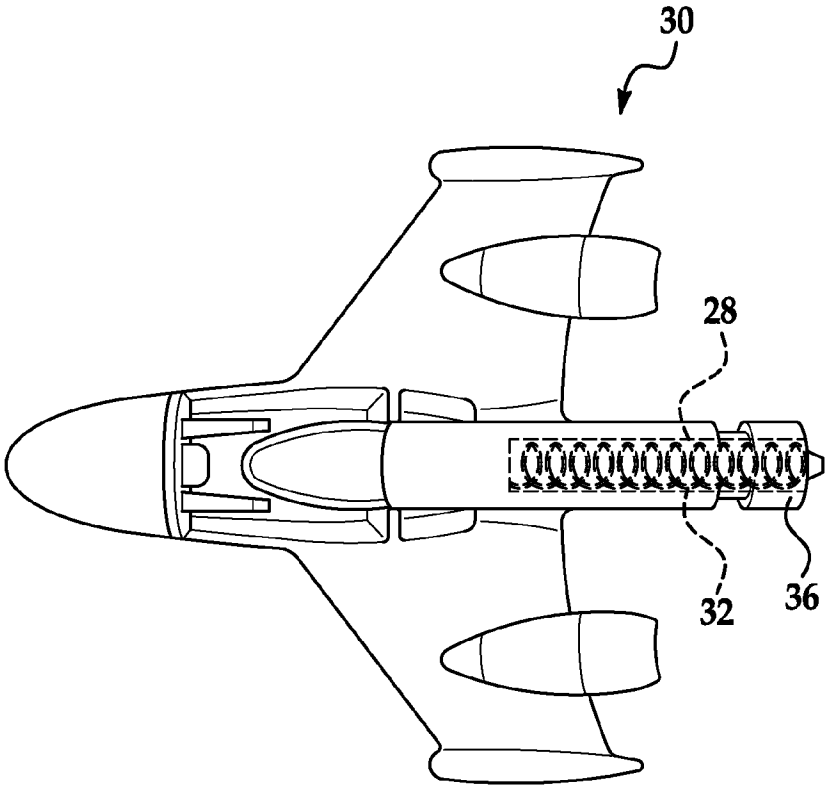
FIG. 4B is a bottom view of the toy airplane.
Figure 4A:
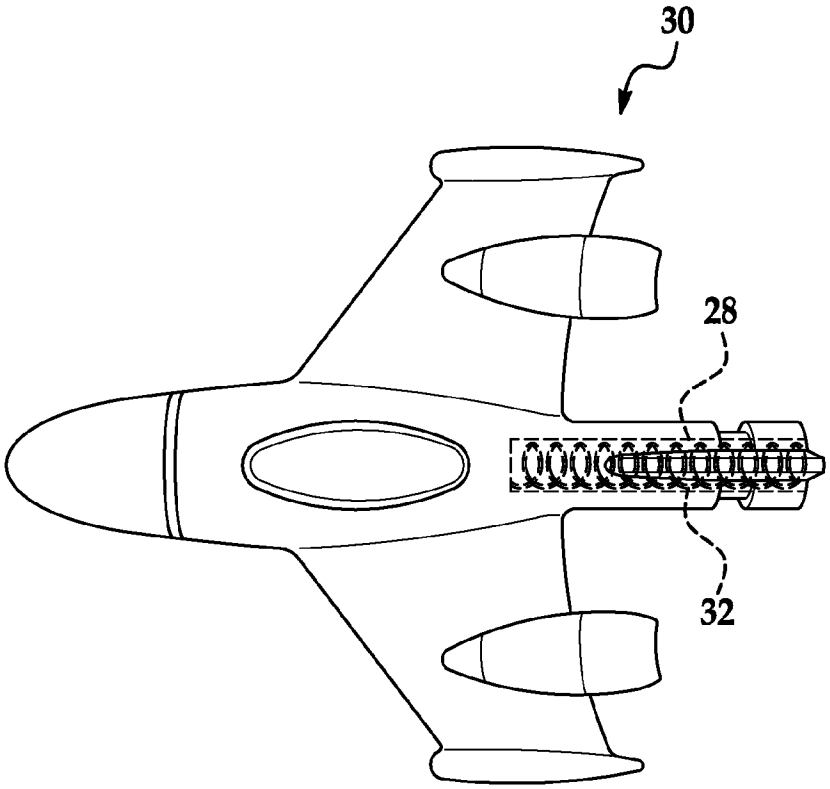
FIG. 4A is a top view of a toy airplane for use the track set.

Located upon a top portion of structure 24 is a launch member 26 that is configured to be slidably received within an opening 28 of a toy airplane 30 (see FIGS. 4A and 4B). Accordingly, toy airplane 30 can be slidably received upon launch member 26 so that a spring 32 located within opening 28 can be compressed until a release mechanism 34 engages a notch 36 on the toy airplane 30. As such, the toy airplane 30 when slid upon launch member 26 causes spring 32 to be compressed. Release mechanism 34 retains the toy airplane on the launch member 26 so that spring 32 remains in its compressed state. The stored potential energy of spring 32 is used to release and launch the toy airplane 30 from launcher 18 when a trigger 38 coupled to the release mechanism 34 is moved by the toy vehicle 12 as the toy vehicle 12 travels along the track path 16. In an alternative embodiment and as illustrated by the dashed lines in FIGS. 2A and 2B, spring 32 can be positioned on launch member 26.

As illustrated, target 38 is positioned above the track segments 14 and as a toy vehicle 12 travels into opening 22, the toy vehicle 12 contacts and moves the target 38. Movement of target 38 causes the release mechanism 34 to move from a first position wherein a feature 40 of the release mechanism 34 is received within notch 36 (see FIG. 4B) to a second position wherein the feature 40 is no longer received within the notch 36 and thus, the potential energy of compressed spring 32 launches the toy airplane 30 from the launch member 26. Once this occurs, the toy airplane 30 travels in the direction of arrow 42 (see FIG. 1) towards an indicator mechanism 44.

Referring to FIG. 1, once the toy vehicle 12 has contacted target 38, the toy vehicle 12 continues on the track path 16 towards indicator mechanism 44. In accordance with one non-limiting exemplary embodiment, target 38 is placed slightly above the track segments 14 so that the toy vehicle 12 will contact and move the target 38 without substantially slowing the toy vehicle 12 down so that the toy vehicle 12 may continue on towards indicator mechanism 44.

Figure 3B:
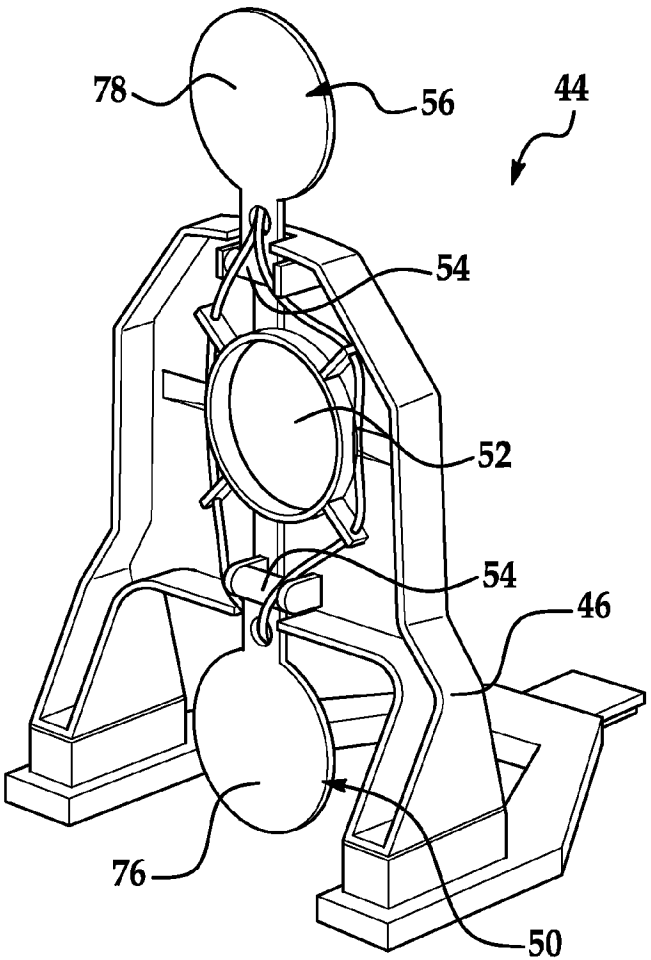
FIG. 3B is a rearward perspective view of the indicator mechanism.
Figure 3A:
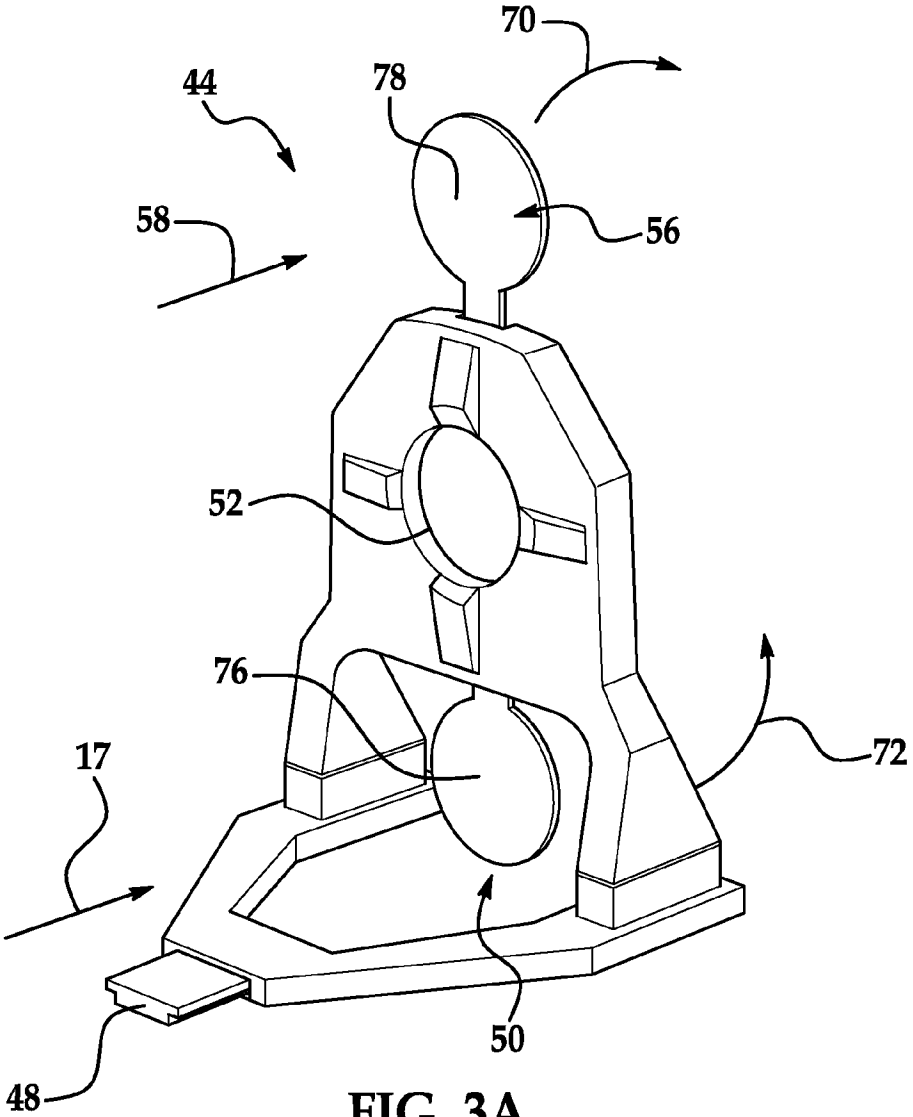
FIG. 3A is a forward perspective view of an indicator mechanism for use with the track set.

Indicator mechanism 44 is also illustrated in FIGS. 3A and 3B. Indicator mechanism 44 has a structure 46. Structure 46 further comprises a connector 48 that is configured to slidably receive one of the track segments 14 so that track path 16 is directed towards a vehicle target 50 of the indicator mechanism 44. Vehicle target 50 is pivotally mounted to the base structure 46 for movement between a first position (illustrated in FIGS. 3A and 3B) wherein the vehicle target 50 is positioned above the track path 16 so that the vehicle target 50 can be contacted by the toy vehicle 12 when the toy vehicle 12 reaches indicator mechanism 44. Once vehicle target 50 is contacted by toy vehicle 12, the vehicle target 50 transitions or moves from the first position to a second position wherein the target 50 is aligned with opening 52 of the base structure 46.

Accordingly and when the vehicle target 50 is located in the first position, the target 50 can be contacted by a toy vehicle 12 traveling along the track path 16 and once the vehicle target 50 is contacted, the target 50 moves to a second position in which the target 50 is aligned with opening 52. In order to assist the movement of vehicle target 50 from the first position to the second position, an elastic member 54 is secured to the vehicle target 50 (see at least FIG. 3B).

Structure 46 further comprises an airplane target 56 pivotally mounted to the base structure above opening 52. Airplane target 56 is capable of movement from a first position (illustrated in FIGS. 3A and 3B) wherein the airplane target 56 is positioned above the opening 52 so that the target 56 can be contacted by the toy airplane 30 when the toy airplane 30 reaches indicator mechanism 44. Once airplane target 56 is contacted by toy airplane 30, target 56 transitions or moves from the first position to a second position in which the target 56 is aligned with opening 52 of the base structure 46.

Similar to the vehicle target 50, and in order to assist the movement of airplane target 56 from the first position to the second position, an elastic member 54 is secured to the airplane target 56 (see at least FIG. 3B). This may or may not be the same elastic member secured to the vehicle target 50. In any event, contact of the airplane target 56 by the toy vehicle airplane 30 traveling in the direction of arrow 58 causes the airplane target 56 to pivot or rotate in the direction of arrow 70 and thus, align the airplane target 56 with opening 52.

In similar fashion, movement of the toy vehicle 12 in the direction of arrow 17 results in the toy vehicle 12 contacting the toy vehicle target 50 and pivoting the toy vehicle target 50 in the direction of arrow 72, thereby aligning the toy vehicle target 50 with opening 52.

The target (50, 56) that is viewable through the opening 52 on the front side of the indicator mechanism 44 (FIG. 3A) depends on which target (50, 56) is contacted first. Accordingly, indicator mechanism 44 provides a means for determining which toy vehicle (e.g., toy vehicle 12 or toy airplane 30) has won a race from the launcher mechanism 18 to the indicator mechanism 44.

For example and during use of the play set or track set 10, a toy vehicle 12 can be positioned at an elevated location 74 of track path 16 and then released so that gravity draws the toy vehicle 12 downwardly towards the launcher mechanism 18 in the direction of arrows 17. Once the toy vehicle 12 reaches the launcher mechanism 18, the toy vehicle 12 contacts target 38 and causes the toy airplane 30 to be launched from the launcher mechanism 18 via the release of the potential energy of spring 32.

At this point, the toy vehicle 12 and the toy airplane 30 simultaneously travel towards the indicator mechanism 44. The toy vehicle 12 travels on land (e.g. along track path 16) while the toy airplane 30 travels in the air in the direction of arrow 42. As such, the play set or track set 10 allows an individual to race an airplane against a car.

As mentioned above, indicator mechanism 44 has a respective target 50, 56 for each one of the toy vehicle 12 and the toy airplane 30. As illustrated in at least FIGS. 3A and 3B, target 50 is provided with indicia 76 that corresponds to the toy vehicle 12 while target 56 is provided with indicia 78 that corresponds to toy airplane 30. Accordingly, the indicia 76 or 78 of the first target to be contacted by either the toy vehicle 12 or the toy airplane 30 will be visually perceivable in opening 52 when viewed from the front side of the indicator mechanism 44 (FIG. 3A). Thus, this indicia will provide an indication of the winner of the race (e.g., toy vehicle 12 versus toy airplane 30 from launcher mechanism 18 to indicator mechanism 44).

In an alternative embodiment and referring to FIGS. 2A and 2B, launch member 26 may be pivotally mounted to a structure 24 such that the launch member 26 can be moved upwardly and downwardly in the direction of arrows 80. Movement of the launch member 26 in the direction of arrows 80 allows the trajectory of the toy airplane (e.g., arrow 42) to be varied and thus providing variations in play. For example, additional track sections 14 and/or stunts or features can be added to the track or play set 10 as the flight path of the toy airplane 30 can be varied. Movement of launch member 26 may be facilitated by knobs 82.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A toy vehicle track set, comprising:

a contact indicator mechanism including at least one target;

a toy vehicle;

a toy airplane;

at least one track segment guiding the toy vehicle along a pathway through a launcher and towards the contact indicator mechanism;

the launcher including the toy airplane and configured for launching the toy airplane towards the contact indicator mechanism; and a trigger mechanism attached to the launcher and the at least one track segment along the pathway of the toy vehicle, wherein:

(i) the trigger mechanism is contacted and actuated by the toy vehicle as the toy vehicle travels along the pathway;

(ii) the actuation of the trigger mechanism simultaneously launches the toy airplane from the launcher towards the contact indicator mechanism as the toy vehicle continues down the pathway towards the contact indicator mechanism; and (iii) the contact indicator mechanism is positioned in the path of both the toy vehicle traveling along the pathway and the toy airplane launched from the launcher, both of which are simultaneously traveling towards the at least one target of the contact indicator mechanism.

2. The track set of claim 1, wherein the launcher comprises a movable member that allows a trajectory of the toy airplane to be adjusted.

3. The track set of claim 1, wherein the launcher further comprises a biasing mechanism whose biasing force is released when the trigger mechanism is actuated.

4. The track set of claim 1, wherein the contact indicator mechanism includes a base structure, and wherein the at least one target is a first target pivotally mounted to the base structure for movement between a first position in which the first target is contacted by the toy vehicle as the toy vehicle travels along the pathway and a second position in which the first target is aligned with an opening in the base structure.

5. The track set of claim 4, wherein the at least one target includes a second target pivotally mounted to the base structure for movement between a first position in which the second target is contacted by the toy airplane launched from the launcher and a second position in which the second target is aligned with the opening in the base structure.

6. The track set of claim 5, wherein each of the first target and the second target is biased towards its respective second position by an elastic member.

7. The track set of claim 5, wherein one of the first target or the second target is alternatively viewable in the opening of the base structure after one of the simultaneously moving toy vehicle and the toy airplane have reached the contact indicator mechanism, the target viewable in the opening indicating which one of the simultaneously moving toy vehicle and the toy airplane has reached the contact indicator mechanism first.

8. The track set of claim 5, wherein the first target has indicia corresponding to the toy vehicle and the second target has indicia corresponding to the toy airplane.

9. The track set of claim 1, wherein the launcher includes a structure having a connector configured to receive the at least one track segment to define a portion of the pathway for the toy vehicle.

10. The track set of claim 9, wherein the contact indicator mechanism includes a connector configured to receive the at least one track segment to define a portion of the pathway for the toy vehicle.

11. The track set of claim 1, wherein the pathway of the toy vehicle extends through the launcher.

12. A track set for toy vehicles, comprising:

a plurality of track segments defining a track pathway;

a first toy vehicle configured to travel on the plurality of track segments along the track pathway;

a second toy vehicle;

a launcher including the second toy vehicle and configured for launching the second toy vehicle, the launcher having a trigger mechanism movably mounted to the launcher for movement between a first position and a second position, the first toy vehicle moving the trigger mechanism from the first position to the second position as the first toy vehicle travels along the track pathway and through the launcher, the first toy vehicle continuing down the track pathway after passing through the launcher, and wherein movement of the trigger mechanism from the first position to the second position by the first toy vehicle causes the second toy vehicle to be launched from the launcher; and a contact indicator mechanism positioned along the track pathway in the path of both the first toy vehicle traveling along the track pathway and the second toy vehicle launched from the launcher, both of which are simultaneously traveling towards the contact indicator mechanism.

13. The track set of claim 12, wherein the launcher comprises a movable member that allows a trajectory of the second toy vehicle to be adjusted.

14. The track set of claim 12, wherein the launcher includes a spring for launching the second toy vehicle from the launcher when the trigger mechanism is moved from the first position to the second position.

15. The track set of claim 12, wherein the contact indicator mechanism includes a first pivotally mounted target moveable between a first position in which the first pivotally mounted target is contacted by the first toy vehicle traveling along the track pathway and a second position in which the first pivotally mounted target is aligned with an opening in the contact indicator mechanism.

16. The track set of claim 15, wherein the contact indicator mechanism includes a second pivotally mounted target moveable between a first position in which the second pivotally mounted target is contacted by the second toy vehicle launched from the launcher and a second position in which the second pivotally mounted target is aligned with the opening of the contact indicator mechanism.

17. The track set of claim 16, wherein each of the first pivotally mounted target and the second pivotally mounted target is biased towards its respective second position by an elastic member.

18. The track set of claim 16, wherein one of the first pivotally mounted target or the second pivotally mounted target is viewable in the opening of the contact indicator mechanism after one of the first toy vehicle and the second toy vehicle have reached the contact indicator mechanism, the target viewable in the opening indicating which of the first toy vehicle and the second toy vehicle has reached the contact indicator mechanism first.

19. The track set of claim 16, wherein the first pivotally mounted target has indicia corresponding to the first toy vehicle and the second pivotally mounted target has indicia corresponding to the second toy vehicle.

20. The track set of claim 12, wherein the launcher includes a connector configured to receive at least one of the plurality of track segments that defines a portion of the track pathway path that passes through the launcher.

* * * * *

UNITED STATES PATENT AND TRADEMARK OFFICE

CERTIFICATE OF CORRECTION

PATENT NO. : 9,352,238 B2
APPLICATION NO. : 14/039946
DATED : May 31, 2016
INVENTOR(S) : Nuttall et al.

It is certified that error appears in the above-identified patent and that said Letters Patent is hereby corrected as shown below:

In the claims,

Column 7, line 8, delete "path".

Signed and Sealed this
Ninth Day of August, 2016

Michelle K. Lee

Michelle K. Lee
*Director of the United States Patent and Trademark Office*